US011421386B2

(12) United States Patent
Chen et al.

(10) Patent No.: US 11,421,386 B2
(45) Date of Patent: Aug. 23, 2022

(54) INNER LINER FOR A CIGARETTE

(71) Applicant: Guangzhou Huadu Lianhua Packing Material Co., Ltd., Guangzhou (CN)

(72) Inventors: Bifeng Chen, Guangzhou (CN); Kanglei Chen, Guangzhou (CN)

(73) Assignee: Guangzhou Huadu Lianhua Packing Material Co., Ltd., Guangzhou (CN)

( * ) Notice: Subject to any disclaimer, the term of this patent is extended or adjusted under 35 U.S.C. 154(b) by 538 days.

(21) Appl. No.: 16/498,362

(22) PCT Filed: Jul. 21, 2017

(86) PCT No.: PCT/CN2017/093778
§ 371 (c)(1),
(2) Date: Sep. 26, 2019

(87) PCT Pub. No.: WO2018/184320
PCT Pub. Date: Oct. 11, 2018

(65) Prior Publication Data

US 2020/0032457 A1 Jan. 30, 2020

(30) Foreign Application Priority Data

Apr. 7, 2017 (CN) ..... 201710224333.6

(51) Int. Cl.
*D21H 23/50* (2006.01)
*A24F 25/02* (2006.01)
*D21H 27/10* (2006.01)

(52) U.S. Cl.
CPC ..... *D21H 23/50* (2013.01); *A24F 25/02* (2013.01); *D21H 27/10* (2013.01)

(58) Field of Classification Search
CPC ..... D21H 19/82; D21H 19/02; D21H 23/50; D21H 27/10; D21H 19/84; A24F 25/02
USPC ..... 131/248
See application file for complete search history.

(56) References Cited

U.S. PATENT DOCUMENTS

| | | | |
|---|---|---|---|
| 5,427,235 | A | 6/1995 | Powell et al. |
| 5,542,529 | A | 8/1996 | Hein, III et al. |
| 5,732,825 | A | 3/1998 | Ikenoya et al. |
| 2007/0193896 | A1 | 8/2007 | Tanbo et al. |

FOREIGN PATENT DOCUMENTS

| | | | |
|---|---|---|---|
| CN | 1789478 | A | 6/2006 |
| CN | 101135124 | A | 3/2008 |
| CN | 101225622 | A | 7/2008 |
| CN | 101270557 | A | 9/2008 |
| CN | 101275373 | A | 10/2008 |
| CN | 102505563 | A | 6/2012 |
| CN | 103015269 | A | 4/2013 |
| CN | 202969166 | U | 6/2013 |
| CN | 203514124 | U | 4/2014 |
| CN | 103774493 | A | 5/2014 |
| CN | 103981773 | A | 8/2014 |
| CN | 205711552 | U | 11/2016 |
| CN | 106868931 | A | 6/2017 |
| CN | 207109454 | U | 3/2018 |
| JP | S576534 | A | 1/1982 |
| JP | H0465599 | A | 3/1992 |
| JP | H04226344 | A | 8/1992 |
| JP | H05195487 | A | 8/1993 |
| KR | 200331076 | Y1 | 10/2003 |
| RU | 2481953 | C1 | 5/2013 |

OTHER PUBLICATIONS

International Search Report issued in application No. PCT/CN2017/093778 dated Jan. 12, 2018.
Written Opinion issued in application No. PCT/CN2017/093778 dated Jan. 12, 2018.
RU Office Action Issued by the Rospatent in Application No. 2019125314/05 dated Apr. 9, 2020.
EP Extended Search Report Issued by the EPO in EP Application No. 17904569.5 dated Sep. 25, 2020.
Notification to Grant Patent Right for Invention dated Aug. 2, 2018, for corresponding Chinese Patent Application No. 201710224333.6.
Decision on Examination of Request for Invalidation dated Dec. 3, 2020, for corresponding Chinese Patent Application No. 201710224333.6.
First Chinese Office Action dated Dec. 1, 2017, for corresponding Chinese Patent Application No. 201710224333.6.
Communication pursuant to Article 94(3) dated Jun. 30, 2021, for corresponding European Patent Application No. 17904569.5.
Notice of Reasons for Refusal dated May 31, 2021, for corresponding Japanese Patent Application No. 2019-555150.
Notice of Reasons for Refusal dated Jan. 13, 2022, for corresponding Japanese Patent Application No. 2019-555150.
Notice of Opinion dated May 27, 2021, for corresponding Korean Patent Application No. 10-2019-7029616.
Patent Grant Decision dated Nov. 26, 2021, for corresponding Korean Patent Application No. 10-2019-7029616.
Decision to Grant a Patent for an Invention dated Jun. 17, 2020, for corresponding Russian Patent Application No. 2019125314/05.

*Primary Examiner* — Mark Halpern
(74) *Attorney, Agent, or Firm* — Renner, Otto, Boisselle & Sklar, LLP

(57) ABSTRACT

A moisture-retaining, quality-preserving and aroma-keeping vacuum aluminum-plated inner liner for cigarettes and method of making the inner liner, the inner liner including a raw paper layer, an upper surface of the raw paper layer being provided with a hot melt sealing layer, a water-based sealing layer, a vacuum aluminum-plated layer, and a water-based protective layer, where a lower surface of the raw paper layer is provided with a moisture returning layer and the inner liner further includes a moisture-retaining and aroma-keeping layer disposed on the upper surface or the lower surface of the raw paper layer.

4 Claims, 1 Drawing Sheet

INNER LINER FOR A CIGARETTE

This application is a 371 of PCT/CN2017/093778 filed 21 Jul. 2017.

TECHNICAL FIELD

The present invention relates to an inner liner paper and a process for manufacturing the same, and, in particular, relating to a moisture-retaining, quality-preserving and aroma-keeping vacuum aluminum-plated inner liner for cigarettes packaging and a corresponding process for manufacturing the same, which falls into the technical field of papermaking.

BACKGROUND

The cigarette inner liner is used as a supporting material for cigarette packaging; its function is to separate the cigarettes. The cigarette inner liner paper currently used on the market mainly consists of four types: aluminum foil composite inner liner, aluminized transfer inner liner, vacuum-aluminized inner liner and aluminum-free inner liner. Due to the difference in moisture permeability index of the inner liner and its calibrated moisture content (5%±1%), when the cigarettes put into the market after packaging is finished, with the storage time and differences of relative humidity and temperature in the environment, the moisture of the cigarette itself will be mildewed due to a long storage time and a storage environment of high temperature and high humidity, while the storage environment of low temperature and low humidity will affect the quality of cigarettes. Therefore, it has always been an urgent problem to be solved in the cigarette field: how to solve the problem that the quality of cigarette changes caused by change of relative humidity and temperature.

SUMMARY

The object of the present invention is to overcome the defect in the prior art and to provide a moisture-retaining, quality-preserving and aroma-keeping vacuum aluminum-plated inner liner for cigarettes. In addition, another object of the present invention is to provide a process for manufacturing the inner liner.

To achieve the above objects, the present invention adopts the following technical solutions:

A moisture-retaining, quality-preserving and aroma-keeping vacuum aluminum-plated inner liner for cigarettes, comprising a raw paper layer, wherein: an upper surface of the raw paper layer is also sequentially provided with a hot melt sealing layer, a water-based sealing layer, a vacuum aluminum-plated layer and a water-based protective layer from the inside to the outside; a lower surface of the raw paper layer is provided with a moisture returning layer; the inner liner further comprises a moisture-retaining and aroma-keeping layer disposed on the upper surface or the lower surface of the raw paper layer.

Preferably, the moisture-retaining and aroma-keeping layer is disposed between the raw paper layer and the hot melt sealing layer.

Preferably, the moisture-retaining and aroma-keeping layer is disposed between the raw paper layer and the moisture returning layer.

Preferably, the moisture-retaining and aroma-keeping layer is a material layer of inorganic powder or organic powder, moreover, the moisture-retaining and aroma-keeping layer having a dry coating amount of 1 $g/m^2$-5 $g/m^2$.

Preferably, the inorganic powder or the organic powder has a particle diameter of 0.3-100 μm and a specific surface area of 30-2000 $g/m^2$.

Preferably, the hot melt sealing layer is a layer of polymer material, and the polymer material has a hot-melt temperature of 100° C.-180° C.

Preferably, the water-based sealing layer is a polymer aqueous emulsion layer or a polymer aqueous resin layer, moreover, the water-based sealing layer having a dry coating amount of 1 $g/m^2$-5 $g/m^2$, and a smoothness of 400 s-1000 s.

Preferably, the vacuum aluminum-plated layer has a thickness of 300 Å-500 Å.

Another object of the present invention: a manufacturing process for the inner liner as described in the above; it comprises the following manufacturing steps:

1) forming a moisture-retaining and aroma-keeping layer on the upper surface of the raw paper layer by the way of roll coating or spray coating, wherein the moisture-retaining and aroma-keeping layer has a dry coating amount of 1 $g/m^2$-5 $g/m^2$ and its curing temperature is 80° C.-120° C.;

2) forming a hot melt sealing layer on the upper surface of the moisture-retaining and aroma-keeping layer by the way of slit coating, moreover, the temperature of the slit coating is 100° C.-180° C. and the coating amount is 8 $g/m^2$-18 $g/m^2$;

3) forming a water-based sealing layer on the surface of the hot melt sealing layer by the way of gravure printing, wherein the water-based sealing layer has a curing temperature controlled at 80-120° C., a surface smoothness controlled at 400 s-1000 s, and a paper moisture content <5%;

4) forming a vacuum aluminum-plated layer on the surface of the water-based sealing layer by vacuum-aluminizing;

5) forming a water-based protective layer on the surface of the vacuum aluminum-plated layer by the way of gravure printing, wherein the water-based protective layer has a dry coating amount of 1 $g/m^2$-5 $g/m^2$ and a curing temperature of 80-120° C.;

6) forming a moisture returning layer on the lower surface of the raw paper layer by adding water to the lower surface of the raw paper layer for wet-processing, so as to control moisture content of finished paper to 5%±1%.

Alternatively, a manufacturing process for the cigarette inner liner paper may comprise the following manufacturing steps:

1) forming a hot melt sealing layer on the upper surface of the raw paper layer by the way of slit coating, moreover, the slit coating having a temperature of 100° C.-180° C. and a coating amount of 8 $g/m^2$-18 $g/m^2$;

2) forming a water-based sealing layer on the surface of the hot melt sealing layer by the way of gravure printing, wherein the water-based sealing layer has a curing temperature controlled at 80-120° C., a surface smoothness controlled at 400 s-1000 s, and a paper moisture content <5%;

3) forming a vacuum aluminum-plated layer on the surface of the water-based sealing layer by the way of vacuum-aluminizing;

4) forming a water-based protective layer on the surface of the vacuum aluminum-plated layer by the way of gravure printing, wherein the water-based protective layer has a dry coating amount of 1 $g/m^2$-5 $g/m^2$ and a curing temperature of 80-120° C.;

5) forming a moisture-retaining and aroma-keeping layer on the lower surface of the raw paper layer by the way of roll coating or spray coating, wherein the moisture-retaining and aroma-keeping layer has a dry coating amount of 1 $g/m^2$-5 $g/m^2$ and a curing temperature of 80° C.-120° C.;

6) forming a moisture returning layer on the lower surface of the moisture-retaining and aroma-keeping layer by adding water to the lower surface of the raw paper layer for wet-processing, so as to control moisture content of finished paper to 5%±1%.

The present invention has the following advantageous effects: the vacuum-aluminized inner liner of the present invention can, through arrangement of the moisture-retaining and aroma-keeping layer, realize absorption of moisture when the cigarette product is stored in an environment of high temperature and high humidity, and realize release of moisture when the product is stored in an environment of low temperature and low humidity, so that it will not reduce the quality of cigarettes as a result of length of storage time or difference of relative humidity and temperature. It can effectively balance the moisture of cigarette products and maintain the quality of cigarette products.

DETAILED DESCRIPTION

The specific embodiments of the present invention are further described below in conjunction with the accompanying figures.

Figure 1:
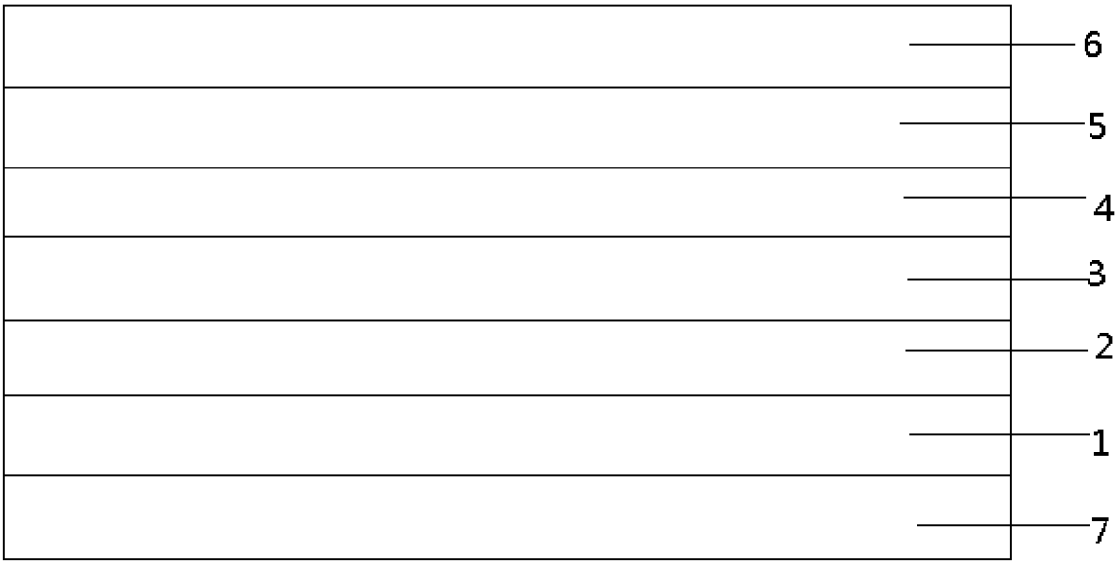
FIG. 1 is a schematic view showing a structure of the moisture-retaining, quality-preserving and aroma-keeping vacuum aluminum-plated inner liner for cigarettes as described in the present invention.
Figure 2:
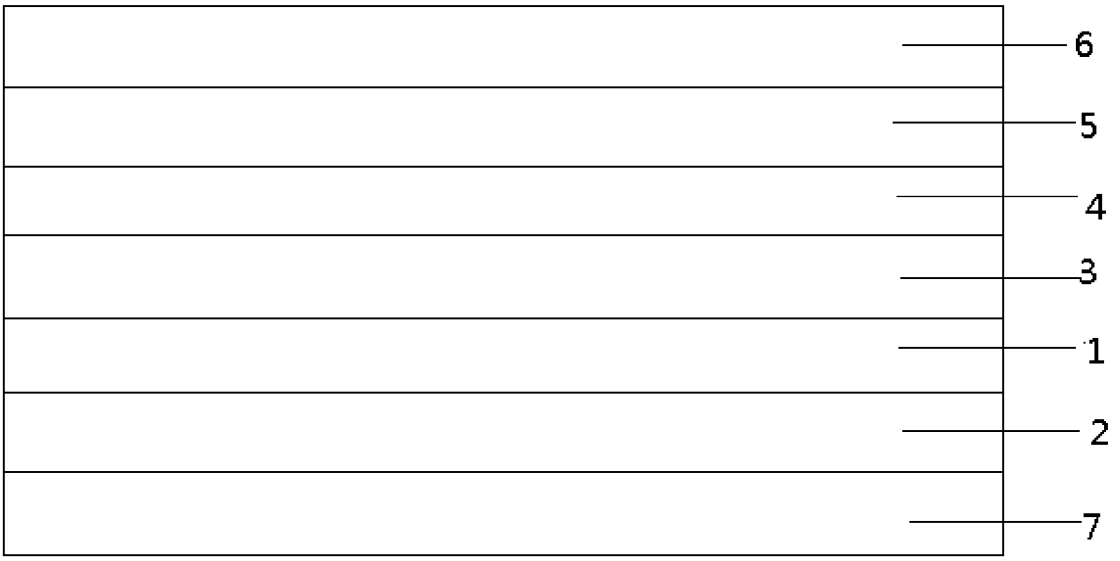
FIG. 2 is a schematic view showing a structure of the moisture-retaining, quality-preserving and aroma-keeping vacuum aluminum-plated inner liner for cigarettes according to another embodiment of the present invention.

As shown in FIG. 1, a moisture-retaining, quality-preserving and aroma-keeping vacuum aluminum-plated inner liner for cigarettes described in the present invention, comprises a raw paper layer 1; an upper surface of the raw paper layer 1 is also sequentially provided with a hot melt sealing layer 3, a water-based sealing layer 4, a vacuum aluminum-plated layer 5 and a water-based protective layer 6 from the inside to the outside; a lower surface of the raw paper layer 1 is also provided with a moisture returning layer 7. In addition, the inner liner paper of the present invention further comprises a moisture-retaining and aroma-keeping layer 2; the moisture-retaining and aroma-keeping layer 2 may be disposed on the upper surface of the raw paper layer 1, between the raw paper layer 1 and the hot melt sealing layer 3. Alternatively, as shown by FIG. 2, the moisture-retaining and aroma-keeping layer 2 may be disposed between the raw paper layer 1 and the moisture returning layer 7.

Specifically, in the present invention, the raw paper layer 1 may adopt an aluminum foil composite raw paper; the hot melt sealing layer 3 is a hot-melt polymer material layer having a hot-melt temperature of 100° C.-180° C., which is formed by coating the hot-melt polymer material on the upper surface of the corresponding raw paper layer 1 or the moisture-retaining and aroma-keeping layer 2 in the way of slit coating, moreover, the slit coating having a temperature of 100° C.-180° C. and a coating amount of 8 $g/m^2$-18 $g/m^2$.

The water-based sealing layer 4 is preferably a polymer aqueous emulsion layer or a polymer aqueous resin layer, which is formed by coating the polymer aqueous emulsion or polymer aqueous resin on the surface of the hot melt sealing layer 3 in the way of gravure printing, so as to seal the gap which may be generated in the hot melt sealing layer 3; moreover, the water-based sealing layer 4 has a dry coating amount controlled at 1 $g/m^2$-5 $g/m^2$, a curing temperature controlled at 80-120° C., a surface smoothness controlled at 400 s-2000 s, and a paper moisture content <5%.

Subsequently, aluminum wire is directly plated on the surface of the water-based sealing layer 4 through vacuum evaporation by the way of vacuum aluminizing, so as to form a vacuum aluminum-plated layer 5, wherein the vacuum aluminum-plated layer 5 has a thickness of 300 Å-500 Å.

The water-based protective layer 6 is formed on the surface of the vacuum aluminum-plated layer 5 by the way of gravure printing to prevent scratching the vacuum aluminum-plated layer 5 and to ensure the smoothing effect of the inner liner paper, wherein the water-based protective layer 6 has a dry coating amount of 1 $g/m^2$-5 $g/m^2$, a curing temperature of 80° C.-120° C., and a groove depth of 30 μm-50 μm as to the gravure adopted.

Adding water to have the lower surface of the raw paper layer 1 subject to wet-processing/humidification processing, so as to form a moisture returning layer 7 on the lower surface of the raw paper layer 1, so that the moisture content of the finished paper is controlled at 5%±1%.

In addition, the inner liner may further comprise a moisture-retaining and aroma-keeping layer 2 disposed between the upper surface of the raw paper layer 1 and the hot melt sealing layer 3 or between the lower surface of the raw paper layer 1 and the moisture returning layer 7; the moisture-retaining and aroma-keeping layer 2 is a material layer of inorganic powder or organic powder, wherein the inorganic powder is a ceramic material powder, and the organic powder is a polymer material powder, and the inorganic powder or the organic powder has a particle diameter of 0.3-100 μm and a specific surface area of 30-2000 $g/m^2$, which is formed on the upper surface or the lower surface of the raw paper layer 1 by roll coating or spray coating; the moisture-retaining and aroma-keeping layer 2 has a dry coating amount of 1 $g/m^2$-5 $g/m^2$; the roll coating uses an anilox roller; its groove depth is 30 μm-80 μm; the quantity for lines of the anilox roller is 10-150; its curing temperature is 80° C.-120° C.

Example 1

A moisture-retaining, quality-preserving and aroma-keeping vacuum aluminum-plated inner liner for cigarettes, with a structure as shown in FIG. 1, comprises a raw paper layer 1, and a moisture-retaining and aroma-keeping layer 2, a hot melt sealing layer 3, a water-based sealing layer 4, a vacuum aluminum-plated layer 5 and a water-based protective layer 6 sequentially stacked on an upper surface of the raw paper layer 1 from the inside to the outside; a moisture returning layer 7 is further formed on a lower surface of the raw paper layer 1. The manufacturing steps of the inner liner comprise:

1) forming a moisture-retaining and aroma-keeping layer 2 on the upper surface of the raw paper layer 1 by coating a ceramic powder having a particle diameter of 50 μm and a specific surface area of 200 $g/m^2$ on the upper surface of the raw paper layer 1 in the way of roll coating, wherein the moisture-retaining and aroma-keeping layer 2 has a dry coating amount of 3 $g/m^2$, the anilox roll used in the roll coating process has a groove depth of 60 μm, the quantity of lines of the anilox roller is 100, and its curing temperature is 100° C.;

2) forming a hot melt sealing layer 3 by coating a hot-melt polymer material having a hot-melt temperature of 150° C. on the upper surface of the moisture-retaining and aroma-keeping layer 2 in the way of slit coating, and the temperature of the slit coating is 150° C., and the coating amount is 10 g/m$^2$;

3) forming a water-based sealing layer 4 by coating a polymer aqueous emulsion on the surface of the hot melt sealing layer 3 in the way of gravure printing, so as to seal the gap which may be generated in the hot melt sealing layer 3; moreover, the water-based sealing layer 4 has a dry coating amount controlled at 3 g/m$^2$, a curing temperature controlled at 100° C., a surface smoothness controlled at 800 s, and a paper moisture content <5%.

5) plating aluminum wire through vacuum evaporation on the surface of the water-based sealing layer 4, so as to form a vacuum aluminum-plated layer 5 having a thickness of 450 Å.

6) forming a water-based protective layer 6 on the surface of the vacuum aluminum-plated layer 5 by the way of gravure printing, to prevent scratching the vacuum aluminum-plated layer 5 and to ensure the smoothing effect of the inner liner, wherein the water-based protective layer 6 has a dry coating amount of 3 g/m$^2$, the curing temperature is controlled at 100° C., and the groove depth of the gravure adopted is 40 μm.

7) forming a moisture returning layer 7 on the lower surface of the raw paper layer 1 by adding water to have the lower surface of the raw paper layer 1 subject to wet-processing/humidification processing, so that moisture content of finished paper is controlled at 5%±1%.

Example 2

A moisture-retaining, quality-preserving and aroma-keeping vacuum aluminum-plated inner liner for cigarettes, with a structure as shown in FIG. 2, comprises a raw paper layer 1, and a hot melt sealing layer 3, a water-based sealing layer 4, a vacuum aluminum-plated layer 5 and a water-based protective layer 6 sequentially stacked on an upper surface of the raw paper layer 1 from the inside to the outside; a moisture-retaining and aroma-keeping layer 2 and a moisture returning layer 7 are sequentially formed on a lower surface of the raw paper layer 1 from the inside to the outside. The manufacturing steps of the inner liner comprise:

1) forming a hot melt sealing layer 3 through coating a hot-melt polymer material having a hot-melt temperature of 120° C. on the upper surface of the raw paper layer 1 in the way of slit coating; moreover, the temperature of the slit coating is 120° C., and the coating amount is 15 g/m$^2$;

2) forming a water-based sealing layer 4 by coating a polymer aqueous resin on the surface of the hot melt sealing layer 3 in the way of gravure printing, so as to seal the gap which may be generated in the hot melt sealing layer 3, and the water-based sealing layer 4 has a dry coating amount controlled at 5 g/m$^2$, a curing temperature controlled at 120° C., a surface smoothness controlled at 400 s, and a paper moisture content <5%;

3) plating aluminum wire through vacuum evaporation on the surface of the water-based sealing layer 4, so as to form a vacuum aluminum-plated layer 5 having a thickness of 350 Å;

4) forming a water-based protective layer 6 on the surface of the vacuum aluminum-plated layer 5 by the way of gravure printing, to prevent scratching the vacuum aluminum-plated layer 5 and to ensure the smoothing effect of the inner liner, wherein the water-based protective layer 6 has a dry coating amount of 5 g/m$^2$, the curing temperature is controlled at 80° C., and the groove depth of the gravure adopted is 50 μm;

5) forming a moisture-retaining and aroma-keeping layer 2 by coating a polymer material power having a particle diameter of 50 μm and a specific surface area of 200 g/m$^2$ on the lower surface of the raw paper layer 1 in the way of roll coating, wherein the moisture-retaining and aroma-keeping layer 2 has a dry coating amount of 1 g/m$^2$, and its curing temperature is 100° C.;

7) forming a moisture returning layer 7 on the lower surface of the raw paper layer 1 by adding water to have the lower surface of the raw paper layer 1 subject to wet-processing/humidification processing, so that moisture content of finished paper is controlled at 5%±1%.

The present invention has been described in detail by the way of preferred embodiments. However, modifications and additions to the various embodiments are obvious to the person with ordinary skill in the art through analyzing and reading the above content. It is the Applicant's intention that all such modifications and additions fall within the scope sought for protection by the Claims of the present invention. The terms used herein are only for the purpose of illustration and description of embodiments, rather than limiting the present invention. Unless otherwise defined, all terms (including technical terms and scientific terms) used herein are the same as those understood by the person with ordinary skill in the art. Any decoration or improvement of this product, and any substitution or use of materials of the same type or similar materials within the scope of the patent, shall all fall into the scope of patent protection of the present invention.

The invention claimed is:

1. A process for manufacturing an inner liner for a cigarette, comprising:

forming a hot melt sealing layer on a upper surface of a raw paper layer by the way of slit coating, moreover, the slit coating having a temperature of between 100° C.-180° C. and a coating amount of between 8 g/m$^2$-18 g/m$^2$;

forming a water-based sealing layer on the surface of the hot melt sealing layer by the way of gravure printing, wherein the water-based sealing layer has a curing temperature controlled at between 80° C.-120° C., a surface smoothness controlled at between 400 s-1000 s, and a paper moisture content <5%;

forming a vacuum aluminum-plated layer on the surface of the water-based sealing layer by the way of vacuum-aluminizing;

forming a water-based protective layer on the surface of the vacuum aluminum-plated layer by the way of gravure printing, wherein the water-based protective layer has a dry coating amount of between 1 g/m$^2$-5 g/m$^2$ and a curing temperature of between 80° C.-120° C.;

forming a moisture-retaining and aroma-keeping layer on the lower surface of the raw paper layer by the way of roll coating or spray coating, wherein the moisture-retaining and aroma-keeping layer has a dry coating amount of between 1 g/m$^2$-5 g/m$^2$ and a curing temperature of between 80° C.-120° C.; and forming a moisture returning layer on the lower surface of the moisture-retaining and aroma-keeping layer by adding water to the lower surface of the raw paper layer for wet-processing, so as to control moisture content of finished paper to 5%±1%;

wherein the moisture-retaining and aroma-keeping layer is a material layer of inorganic powder or organic powder;

wherein the hot melt sealing layer is a layer of polymer material, the polymer material having a hot-melt temperature of 100° C.-180° C.;

wherein the water-based sealing layer is a polymer aqueous emulsion layer or a polymer aqueous resin layer, wherein the water-based sealing layer has a dry coating amount of 1 $g/m^2$-5 $g/m^2$.

2. The process according to claim 1, wherein the inorganic powder or the organic powder has a particle diameter of 0.3-100 μm and a specific surface area of between 30 $m^2/g$-2000 $m^2/g$.

3. The process according to claim 2, wherein the inorganic powder is a ceramic material powder.

4. The process according to claim 1, wherein the vacuum aluminum-plated layer has a thickness of between 300 Å-500 Å.

* * * * *